US006167682B1

(12) United States Patent
Moon

(10) Patent No.: US 6,167,682 B1
(45) Date of Patent: Jan. 2, 2001

(54) BUNG CLOSURE AND CENTER ORIFICE

(76) Inventor: Robert B. Moon, 434 W. Rosewood, East Alton, IL (US) 62024

( * ) Notice: Under 35 U.S.C. 154(b), the term of this patent shall be extended for 0 days.

(21) Appl. No.: 09/174,897

(22) Filed: Oct. 19, 1998

(51) Int. Cl.[7] ..... B65B 7/28

(52) U.S. Cl. ..... 53/489; 53/281; 53/321; 53/330; 53/488; 413/2; 413/26

(58) Field of Search ..... 53/489, 488, 487, 53/485, 281, 321, 330; 413/1, 2, 26

(56) References Cited

U.S. PATENT DOCUMENTS

| | | | | |
|---|---|---|---|---|
| 2,207,565 | | 7/1940 | Wackman | 285/49 |
| 3,498,018 | * | 3/1970 | Seiferth | 53/489 X |
| 4,582,209 | | 4/1986 | Moon | 217/108 |
| 4,846,374 | * | 7/1989 | Gabrys | 53/489 X |
| 5,016,775 | | 5/1991 | Budenbender | 220/288 |
| 5,052,576 | | 10/1991 | Budenbender | 220/304 |
| 5,305,906 | | 4/1994 | Dietrich et al. | 220/288 |
| 5,505,233 | | 4/1996 | Roberts et al. | 141/83 |
| 5,617,705 | * | 4/1997 | Sanfilippo et al. | 53/281 X |

* cited by examiner

*Primary Examiner*—James F. Coan
(74) *Attorney, Agent, or Firm*—Haverstock, Garrett and Roberts LLP

(57) ABSTRACT

Drums or vessels with bungs or orifices having generally cylindrical walls with edges capable of being sealed-against are sealed with closures that deform into contact with those edges and provide seals that are tamper-proof.

6 Claims, 7 Drawing Sheets

BUNG CLOSURE AND CENTER ORIFICE

BACKGROUND OF THE INVENTION

1. Field of Invention

The present invention relates to deformable non-threaded closures for containers, such as drums, casks, barrels, and the like, provided with bungs or orifices that have generally cylindrical walls with interior and exterior edges that can be sealed-against. More particularly, the invention relates to tamper-proof closures capable of plugging and sealing orifices with or without internal threads in the orifice walls. The present invention also relates to an additional orifice at the center axis of the vessel, which greatly enhances and facilitates automated filling and capping.

2. Related Art

At present oil drums are filled through threaded orifices that are sealed with screw-type closures that are then crimped with a second piece to make them tamper-proof. Such closures require human intervention and attendant labor cost for their installation, because automation of this process has proven difficult. A need therefore exists for a one-piece closure that can be inserted and sealed quickly and easily without having to engage threads in the vessel head. Cross threads would become a thing of the past.

Many prior art bunghole closures require an added interior drumhead flange, or other interior drumhead support to be able to receive and sealingly hold the closure. The millions of metal drums now in circulation would have to be replaced or unheaded for retrofitting of the interior drumhead support if additional orifices were adopted. There is thus a need for a way to adapt existing containers for use of a deformable non-threaded closure without unheading them.

The traditional side-opening (opening on the lid near the side edge of the lid) on oil drums makes it easier to pour the contents by tipping the drum, but it complicates automatic filling. Despite extensive efforts over many years, packing machinery technicians have been unable to find a convenient and reliable way of finding and aligning the side opening automatically. Spinning the drums about their axes has proven problematic in use because once in service drums often lack a perfectly even side wall surface for engaging drive wheels. Small imperfections, such as dents, rust, grease, loose paint, and the like, in the side walls of the drums disrupt their spinning by the drive wheels. For this reason, some automated fillers will only fill new drums. Lots of these new drums are one way, single trip, not recycled, and not reconditioned. They end up as lidless trash cans, burning barrels, or are simply dumped. The steel drum has taken on a bad image, even often being pictured as a symbol of hazardous waste with a derisive skeleton and crossbones or with the derogatory "XXXX" label on a side. Traction by drive wheels is rendered more unreliable by the spills that commonly occur in a filling operation, particularly if the liquid being filled is a lubricant. In addition, the infrared sensors used to detect the openings need frequent sensitivity adjustments to work properly. The resulting failure to correctly find the side openings consistently causes misalignment of the filling lance with the side opening, and this can require time wasting physical relocations and/or respinnings. Thus edge-filling necessitates extensive operator intervention to operate properly, with attendant labor costs. Furthermore, successful automation of other aspects of oil refinement and packaging make the failure to reliably automate drum filling stand out sharply.

SUMMARY OF THE INVENTION

It is thus an object of the present invention to provide a non-threaded deformable bunghole closure for use on drums, casks, barrels, and other vessels.

It is also an object of the present invention to provide a bunghole closure that can be quickly installed in an automated process.

It is further an object of the present invention to provide a bunghole closure that can be removed quickly and easily, preferably with substantially the same equipment as used to install the bunghole closure.

It is further an object of the present invention to provide a tool for the rapid installation and removal of the bunghole closure.

It is also an object of the present invention to provide a way of adapting a drum for either a threaded or non-threaded deformable bunghole closure without unheading the drum.

It is still further an object of the present invention to provide a way of retrofitting drums presently in service to provide a center orifice to allow center-filling and rapid installation of a tamper-proof bunghole closure.

It is yet another object of this invention to promote three "R's" that help the environment, namely: "Recycle-Reuse-Recondition." This invention should be excellent for the environment by helping to promote reconditioning of drums and keeping them from becoming derelict.

In keeping with the above objects, the present invention provides a non-threaded deformable bunghole closure for an orifice having a generally cylindrical wall with generally flat interior and exterior edges. The closure includes a cylindrical sleeve portion that is capable of entering into and extending substantially between the interior and exterior edges of the orifice wall. An outwardly extending closure lip portion is located near the exterior edge of the sleeve and arranged to extend beyond and be capable of sealing against the exterior edge of the orifice wall. A closure internal portion that is generally shaped as a truncated cone is connected to the interior edge of the closure sleeve by an annular expandable hinge sealed between that edge and the outer rim of the conical internal portion. In an initial conical configuration, the conical internal portion, together with the surrounding sleeve, is capable of entering into the orifice but is arranged so that, when force is applied to substantially flatten the cone, portions of the surrounding sleeve and/or hinge expand outward to extend beyond and exert an upward force against the bottom edge of the orifice wall to hold down the closure. Application of further force, which would generally occur at a separate later time, drives the truncated cone through the flattened position and into the interior of the vessel, thereby inverting the cone so that it points into the drum rather than outward and collapsing the expandable hinge radially inward far enough to allow the unit to be removed from the orifice.

The present invention further meets the above objects by providing a closure installation tool comprising a plurality of gripping segments that, under the action of an expander, move radially outward to grip the interior of the bunghole closure. The tool also has a cylinder or ramrod with a flat end plug that under the action of an impelling force moves forcefully downward to force the apex of the corrugated cone into a substantially horizontal position, thereby sealing the closure in the bunghole.

The present invention also meets the above objects by providing a closure removal tool that also has gripping segments and a cylinder or ramrod, but further includes a hemispherical end cap on the cylinder to yield a ramrod of greater total length than the cylinder with a flat end plug. This tool can be the installation tool with a rounded long rod tip substituted for a short flat rod tip. Under the action of an impelling force the cylinder with hemispherical end cap forces the apex of the crenellated cone below the sealing position into an inverted cone, thereby inverting the corrugated cone, pulling the hinges back radially inward and thus releasing the seal and allowing the inverted closure to be pulled back out of the bunghole.

The invention also provides a method of adapting drumheads to the non-threaded deformable bunghole closure without having to unhead them. A downwardly gradually tapered frustuconical plunger is forced into a hole made in the drumhead to form a well in the interior of the drum. For plunger removal, a collar having radially projecting arms carrying a first set of exterior perimeter rollers is then fastened to the plunger and rotated while being forced downward against the drum. This forms an annular strengthening groove in the exterior of drumhead coaxially about the well and, preferably, applies upward pressure against the plunger to facilitate its removal from the well just formed. Following removal of the plunger and its exterior perimeter rollers, another tool with interior perimeter rollers on radially projecting arms on the lower end of a drive shaft are placed inside the hole and a collar having radially projecting arms carrying a second set of exterior perimeter rollers, which may be of the same diameter and width as used for the strengthening groove or may be different, are fastened to the shaft. The interior and exterior rollers are urged toward each other while either (a) they are rotated about the shaft with respect to the drumhead or (b) they are held rigid and the drumhead is rotated about them. This forms the drumhead material into a rounded horizontal collar on which the horizontal portion of the bunghole closure will rest ringed by a downward projecting ridge for added rigidity. As one moves outward radially from the original hole, one finds the completed bunghole to comprise a well, a collar, and a groove, the well and the collar adapted to fasten with the bunghole closure, and the groove added to increase the strength of the drumhead adjacent to the bunghole.

The invention also meets the particular need to fill oil drums from the center rather than from the side. Center-filling solves all of the above noted edge hole problems. Because the opening is on the drum's cylindrical axis, simply positioning the drum against V-blocks suffices to locate the orifice, thereby obviating infrared sensors. Moreover, no spinning is required, hence the condition of the side wall and the occurrence of any spills becomes irrelevant. Universal adoption of center-filling necessitates retrofitting the millions of side-opening drums now in circulation with a centered bunghole. Such retrofitting must be performed without unheading the drums to be cost-effective and therefore practical. The above method allows this retrofitting to be easily, quickly and accurately done. The center hole for filling is in addition to the side opening still needed for emptying.

In time, the future filling and capping packaging machines may abandon weigh scales and the "fill by weight and sell by volume" concept and go to the more prevalent volumetric machines that "fill by volume and sell by volume" with improvements like this invention.

BRIEF DESCRIPTION OF THE DRAWING

The invention will be better understood by reference to the attached drawing, wherein.

DETAILED DESCRIPTION OF THE INVENTION

Figure 1:
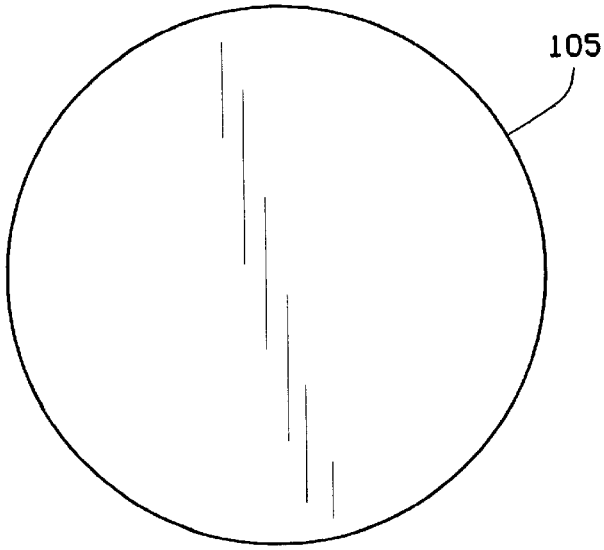
FIG. 1 is a top plan view of a blank before its forming into a bunghole closure.
Figure 2:
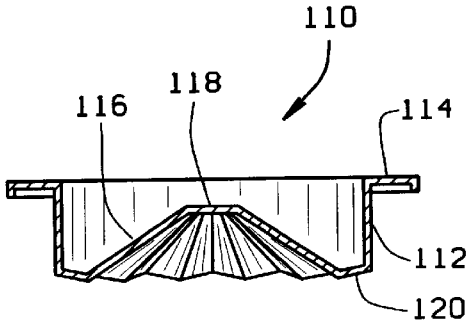
FIG. 2 is a diametric side cross-sectional view of the present bunghole closure before sealing.
Figure 3:
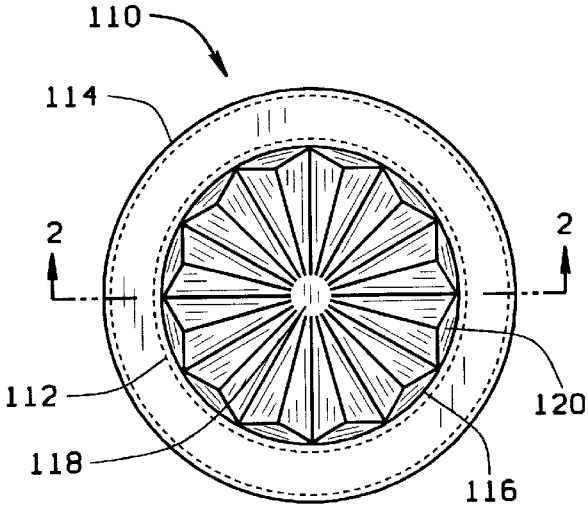
FIG. 3 is a top plan view of the present bunghole closure before sealing.
Figure 4:
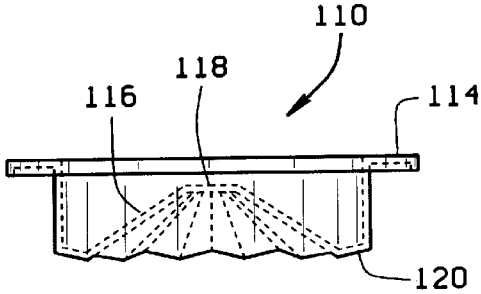
FIG. 4 is a lateral view of the present bunghole closure before sealing.

FIG. 1 shows blank 105 before its forming to become bunghole closure 110. Referring to FIGS. 2–4, bunghole closure 110 comprises a cylindrical closure sleeve 112 connected at its upper exterior edge substantially at right angles to radially-protruding closure lip 114. Corrugated cone 116 is truncated to form flat apex 118, and is connected to the interior edge of closure sleeve 112 by annular sealing hinge 120. The corrugation in cone 116 is included to prevent buckling of the cone by providing additional strength to the cone, and in particular to direct force applied to apex 118 downward and outward to annular sealing hinge 120 to form the seal.

Figure 5:
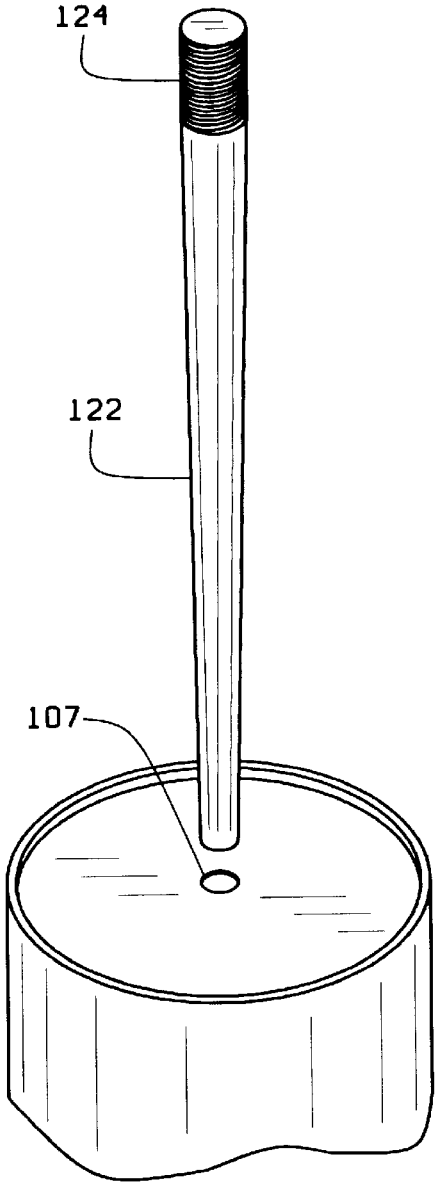
FIG. 5 is a top right front perspective view of a drum with drum center-fill orifice and a conical plunger before insertion into the orifice.
Figure 6:
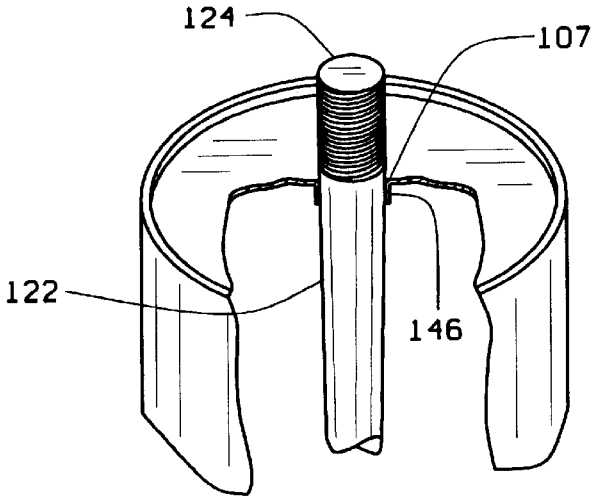
FIG. 6 is a top right front cut-away perspective view of a drum with the conical plunger inserted into the drum orifice.

To adapt a drum for bunghole closure 110, drum orifice 107 is first formed in drumhead 101 by a hole saw, or laser cutting, or other hole-forming means, with drum orifice 107 of a sufficient size to accept bunghole closure 110 following formation of the orifice into a bunghole. In a preferred embodiment, the hole is formed in the center of drumhead 101 to allow for subsequent center-filling. Referring to FIG. 5, frustuconical plunger 122 tapers gradually downward from threads 124 to a tip of sufficiently small diameter to fit within drum orifice 107. Forceful gradual insertion of conical plunger 122 into drum orifice 107 expands the drum orifice and rolls the material comprising drumhead 101 inward into the interior of the drum to form well 146 (shown in FIG. 6 and 8).

Figure 7:
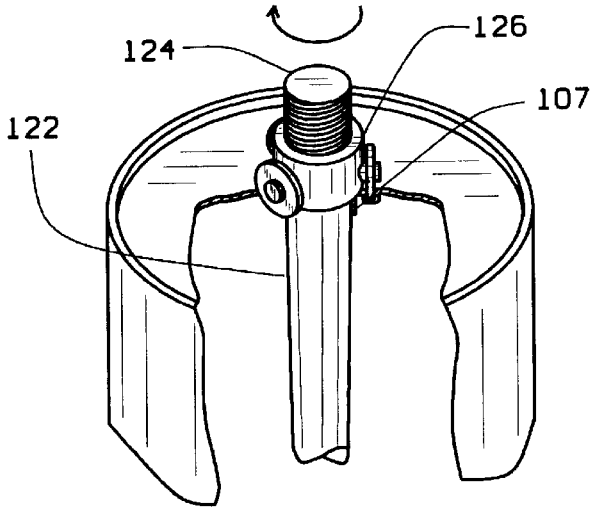
FIG. 7 is a top right front cut-away perspective view of a drum with the conical plunger inserted into the drum orifice and a nut, with exterior perimeter rollers, threaded onto the conical plunger to act as a puller for the plunger.
Figure 8:
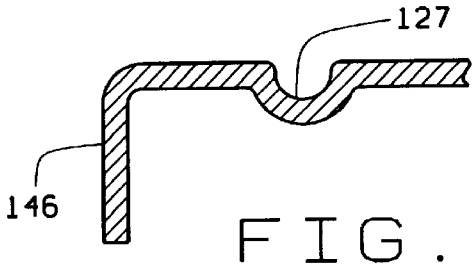
FIG. 8 is a vertical side cross-sectional view of the drum orifice and drumhead after insertion of the plunger and rotation of the nut with exterior perimeter rollers on the conical plunger to form a locating groove in the drumhead.
Figure 9:
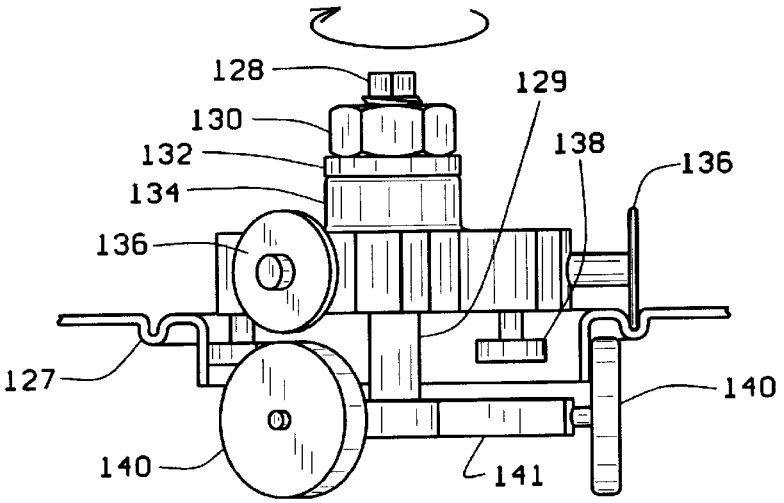
FIG. 9 is a vertical side cross-sectional view of the exterior and interior rollers in place in the drum orifice before the interior and exterior perimeter rollers have been tightened toward each other.

Referring to FIGS. 7 and 8, after insertion of conical plunger 122 fully into drum orifice 107, nut 126 with exterior perimeter rollers is threaded onto threads 124 and threadedly tightened to form strenthening groove 127. The plunger serves to hold and support the well during formation of the strenthening groove. Conical plunger 122 and nut 126 with exterior perimeter rollers are then removed by downward rotation of nut 126 to apply upward force on the plunger 122.

Figure 12:
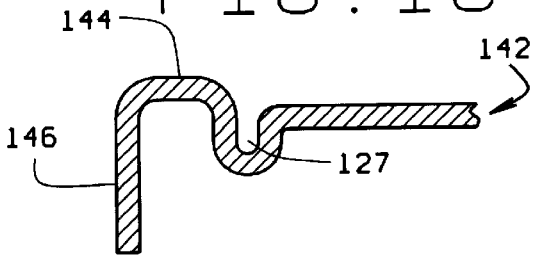
FIG. 12 is a vertical side cross-sectional view of the right portion of a completed bunghole ready for sealing with the bunghole closure.
Figure 13:
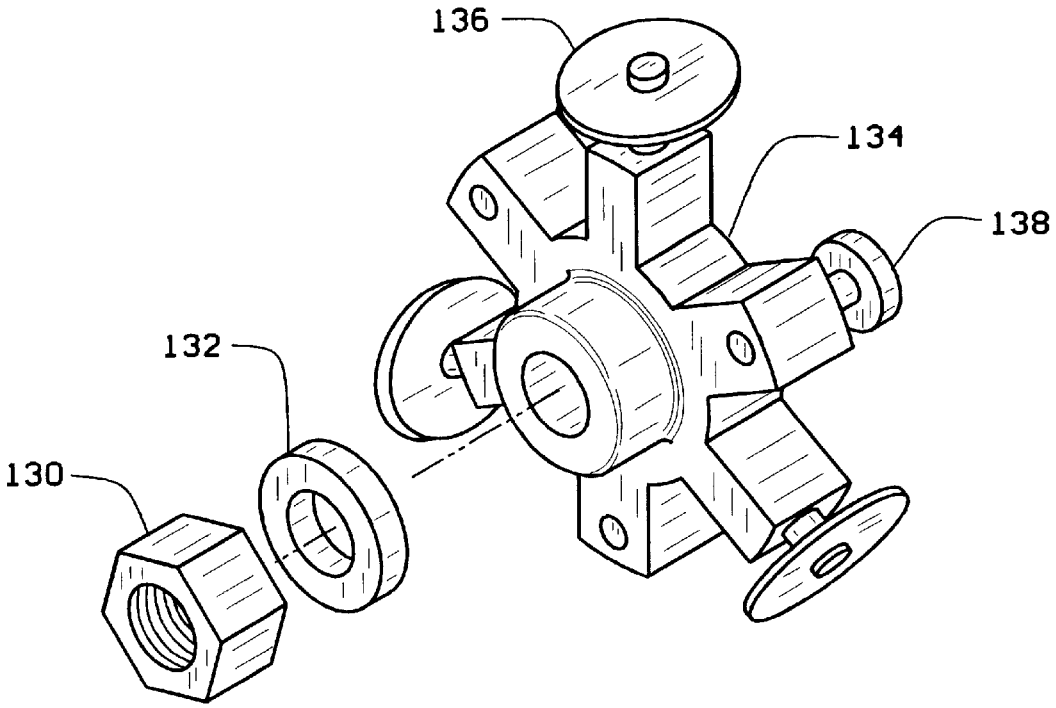
FIG. 13 is an exploded top, left, rear perspective view of the exterior perimeter rollers showing the exterior body, nut, and bell shaped spacer.
Figure 14:
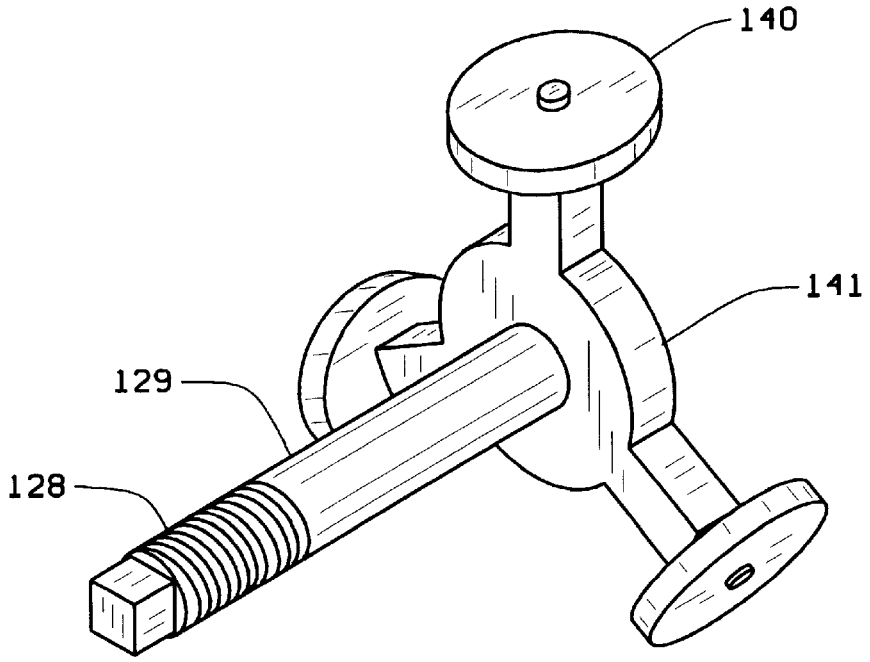
FIG. 14 is a top, left, rear perspective view of the interior perimeter rollers showing the interior body and shaft.

Referring to FIG. 9–14, and first to FIG. 14, interior perimeter rollers 140 on interior body 141 having shaft 129 are then inserted into drum orifice 107 such that shaft 129 and threads 128 protrude from drum orifice 107. Referring to FIG. 13, exterior body 134 bearing exterior perimeter rollers 136 and horizontal restraining roller 138 is placed over shaft 129. Washer 132 is then placed on shaft 129 and nut 130 is threadedly engaged with threads 128 on shaft 129. A spacer or additional washers may be inserted under or over washer 132, if more height is desired.

Figure 10:
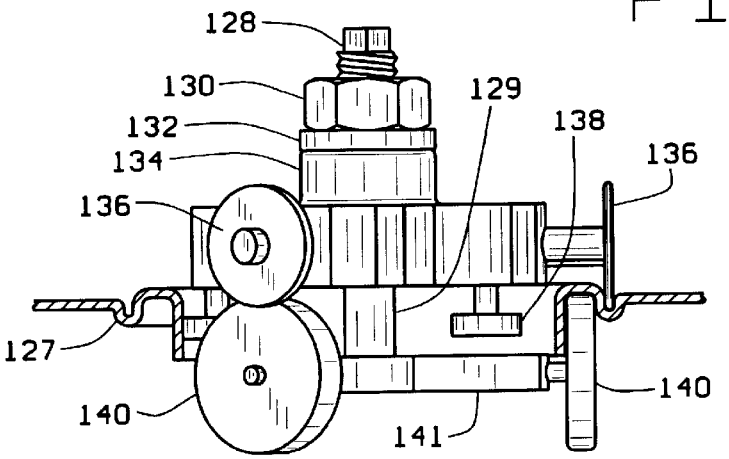
FIG. 10 is a vertical side cross-sectional view of the exterior and interior rollers after being tightened against each other and rotated to form the completed bunghole in the drumhead with a raised gasket surface.
Figure 11:
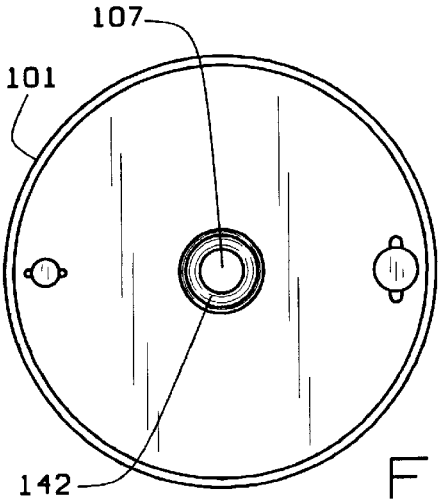
FIG. 11 is a top view of the drumhead showing the completed bunghole ready for sealing with the bunghole closure.

Returning to FIG. 9, tightening of nut 130 forces interior body 141 upward toward exterior body 154, and in so doing forces interior perimeter rollers 140 upward toward second exterior perimeter rollers 136. Referring to FIG. 10, tightening of nut 130 followed by rotation of exterior body 134 and interior body 141 about the axis of shaft 129 with respect to drum orifice 107 deforms the material comprising drumhead 101 into the completed bunghole 142 (FIG. 11), while horizontal restraining roller 138 prevents buckling of well 146 (FIG. 12). Referring to FIG. 12, bunghole 142 comprises groove 127, collar 144, and well 146, which leads to the interior of the drum.

Figure 15:
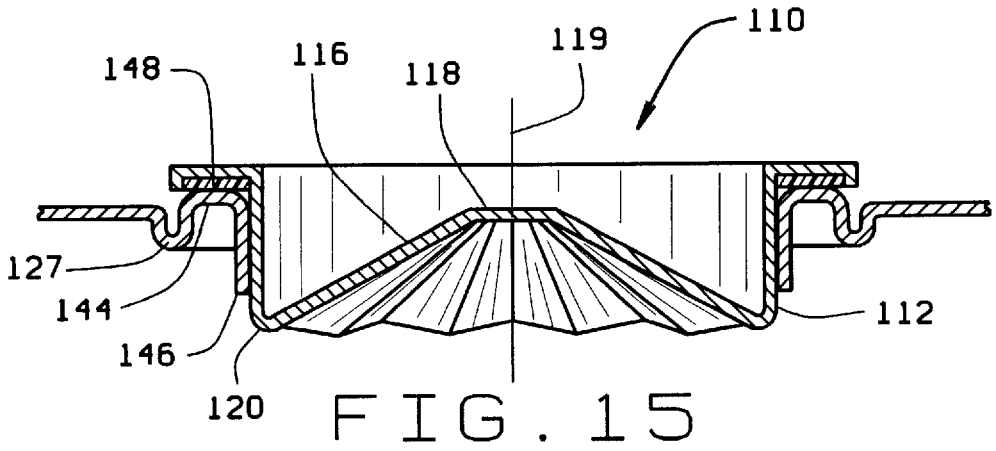
FIG. 15 is a vertical, front, cross-sectional view of the bunghole closure in place in a bunghole before sealing.

Referring next to FIG. 15, before sealing in bunghole 142, bunghole closure 110 has corrugated cone 116 and apex 118 projecting toward the exterior of the drum along axis 119 of cone 116. Closure lip 114 rests upon gasket 148 and collar 144 such that bunghole closure 110 lies slightly raised from drumhead 101, and closure sleeve 112 lies flush against well 146. Before sealing, annular sealing hinge 120 fits within the cylinder defined by well 146, allowing bunghole closure 110 to be inserted and removed freely.

Figure 16:
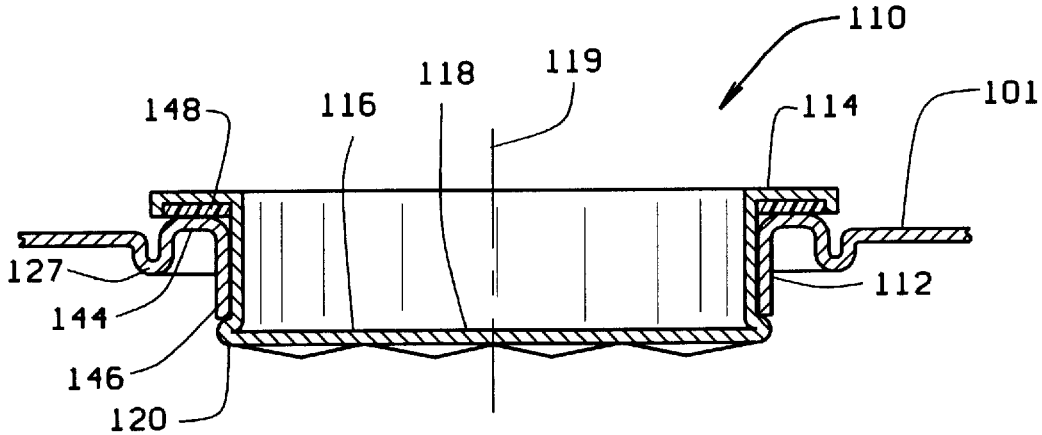
FIG. 16 is a vertical, front, cross-sectional view of the bunghole closure in a bunghole after application of force on the apex of the cone to seal the closure.

Referring to FIG. 16, application of force along axis 119 of cone 116 toward the interior of the drum forces corrugated cone 116 downward into a substantially horizontal position and simultaneously expands annular sealing hinge 120 radially outward so as to extend beyond the radius of well 146, thereby fluidly sealing bunghole closure 110 into drum orifice 107.

Figure 17:
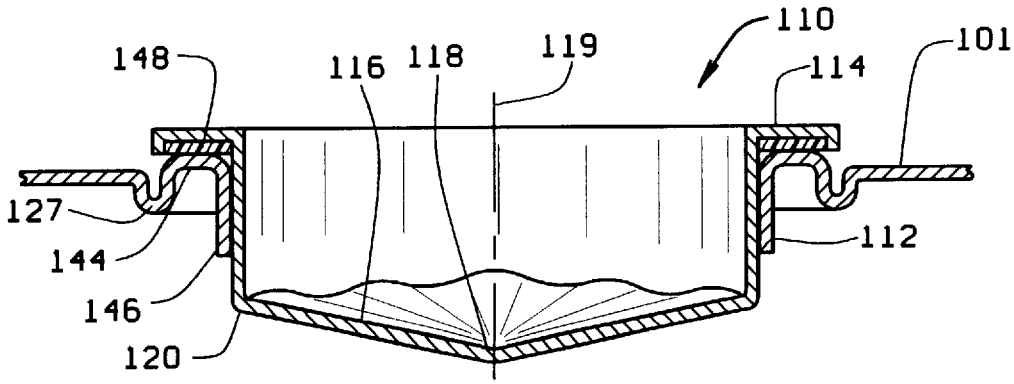
FIG. 17 is a vertical, front, cross-sectional view of the bunghole closure in a bunghole after application of force on the apex of the cone to drive the cone into the interior of the vessel, thereby releasing the seal.

Referring to FIG. 17, application of force further along axis 119 of cone 116 toward the interior of the drum forces corrugated cone 116 into the interior of the drum, allowing annular sealing hinge 120 to contract radially to lie within the radius of well 146, thereby breaking the seal of bunghole closure 110 and allowing its removal from bunghole 142.

Figure 18:
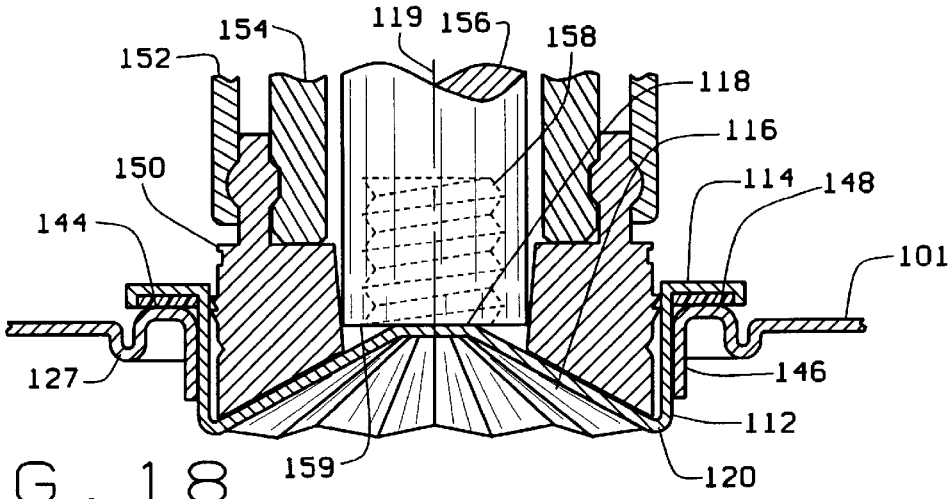
FIG. 18 is a vertical, front, cross-sectional lateral view of the bunghole closure held in a bunghole by the closure installation tool before sealing.
Figure 19:
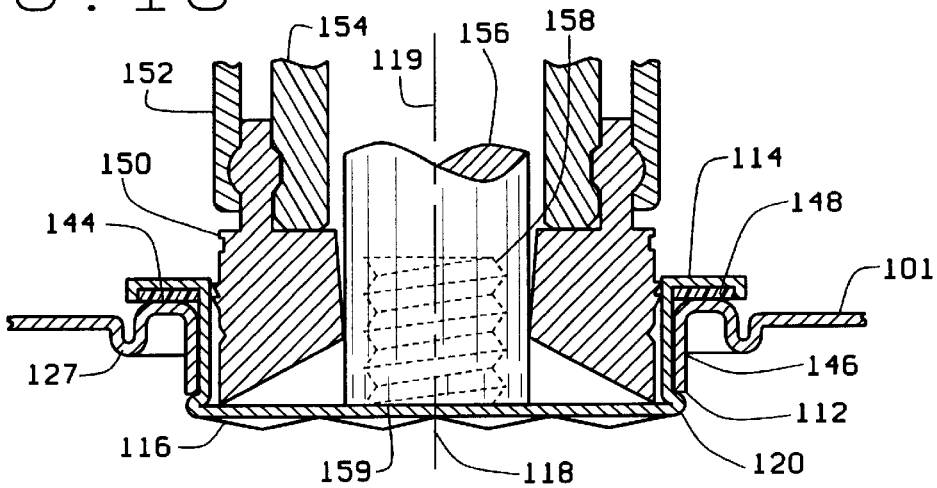
FIG. 19 is a vertical, front, cross-sectional lateral view of the bunghole closure in a bunghole being sealed by the closure installation tool with the flat end plug.

Referring to FIGS. 18 and 19, installation of bunghole closure 110 is achieved with the bunghole closure installation tool, which comprises beveled gripping segments 150, inner support members 154 and outer support members 152, setting plunger 156, and flat end plug 159 engaging cylinder 156 through threads 158. Radial expansion of gripping segments 150 by an expander employing manual, hydraulic, pneumatic, electromagnetic, or electromechanical means causes the segments to grip the interior of closure sleeve 112. Application of force to plunger 156 along its axis by manual, hydraulic, pneumatic, electromagnetic, or electromechanical means forces crenellated cone 116 and apex 118 toward the interior of the drum until crenellated cone 116 lies in a substantially horizontal plane, and annular sealing hinge 120 expands radially to form an outwardly extending gripping flare under and against closure sleeve 112.

Figure 20:
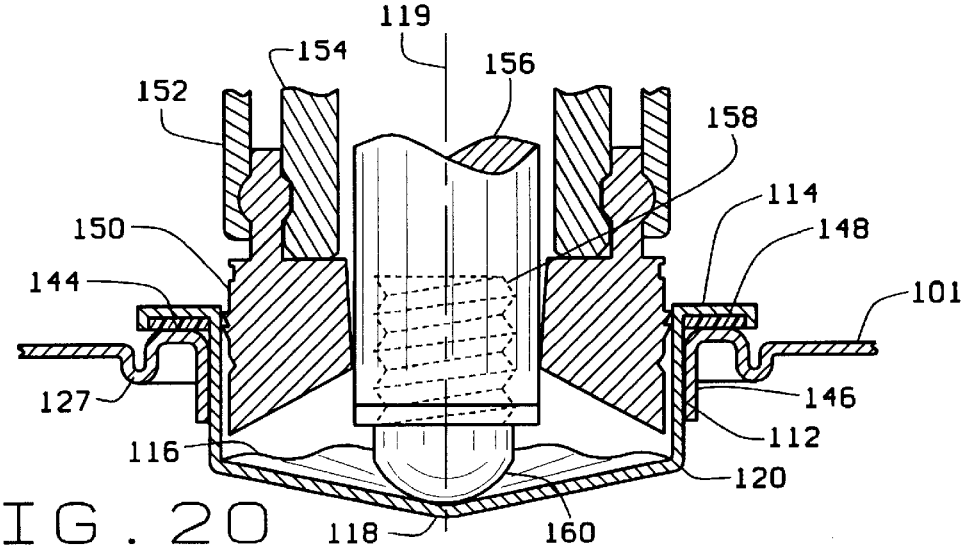
FIG. 20 is a vertical, front, cross-sectional lateral view of a sealed bunghole closure in a bunghole after being opened by the closure removal tool.

Referring to FIG. 20, removal of bunghole closure 110 is achieved by unthreading flat end plug 159 of the installation tool and replacing it with hemispherical end cap 160. Radial expansion of gripping segments 150 by an expander employing manual, hydraulic, pneumatic, electromagnetic, or electromechanical means causes the segments to grip bunghole closure 110 tightly, and then application of force to plunger 156 toward the interior of the drum collapses crenellated cone 116 inward, into the interior of the drum, because of the greater total length of plunger 156 with hemispherical end cap 160 in place than cylinder 156 with flat end plug 159 in place. Collapse of crenellated cone 116 into the interior of the drum allows radial contraction of annular sealing hinge 120, thereby breaking the seal against closure lip 114 and allowing removal of bunghole closure 110.

Figure 21:
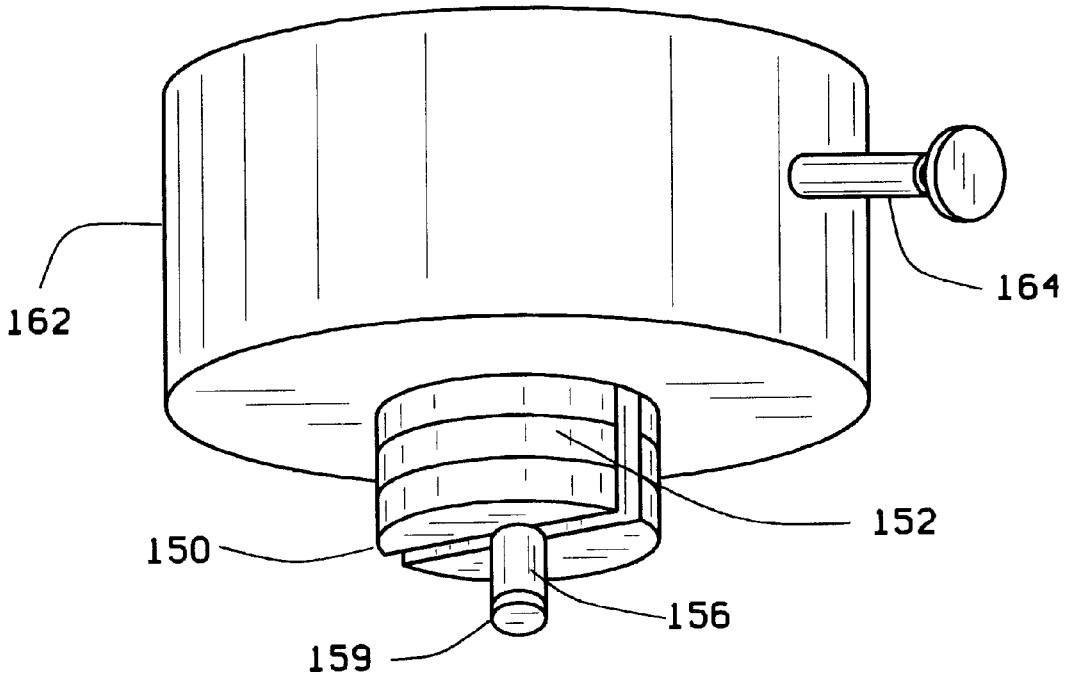
FIG. 21 is a top, right, front perspective view of a combination setting and removing tool for performing the steps in FIGS. 18–20.

Referring to FIG. 21 is a schematic representation of the expander tool with an air cylinder type actuator 162 operated by a control 164.

In general, the present bunghole closures can be constructed of substantially any metal or plastic material having the requisite properties of stiffness, malleability and impermeability. As material suitable for forming a continuous annular hinge about which a corrugated conical interior portion of the bunghole closure must pivot (in order to move from its collapsed to expanded gripping positon and thereafter to its axially extended and radially contracted pre-removal non-gripping position) should have properties substantially analogous to those of an expandable sheet metal such as a 20-gauge expandable sheet metal. Composites of metal and plastic can, of course, be used and the thickness and rigidity of the portions at or near the apex portion of the conical bunghole closure interior portion can be different from that of other portions of the closure. The angle between the sides of the conical portion to its central axis can be varied, for example, by amounts on the order of from 45 degrees to 60 degrees. The size of the truncated portion of the conical element is preferably within the general range of from about 5 to 20 percent of the diameter of the orifice to be closed.

As indicated in the Bureau of Explosives Regulations for Transportation of Explosives and Other Dangerous Articles in rail express and baggage services, ICC No. BOE-6000-C effective May 4, 1983, the regulations for metal barrels, drums, kegs, cases, trunks and boxes, Section 178.80-9, such closures should be adequate to prevent leakage, with gaskets being required, and the closure part being of metal as thick as prescribed for the head of the container, where the container is for more than 12 gallons and the opening to be closed is not over 2.7 inches in diameter. In view of this, the automatic insertion and sealing of the present type closure made of 20-gauge expandable sheet metal may satisfy the requirements for a tamper-proof sealing device.

It is also apparent from the foregoing that the present invention is not limited to the embodiments shown. Other equally effective embodiments are contemplated and within the scope of the present invention.

What is claimed is:

1. A method of sealing an opening in a container, which comprises the steps of:

(a) deforming a portion of the container adjacent the opening to form an inwardly projecting cylindrical wall;

(b) inserting a closure, having an annular sealing portion and conical central portion and an axis, into the opening, the apex of the conical central portion being toward the exterior of the container; and (c) applying axial pressure into to the opening directly against said apex to move said apex a limited distance into the opening to reduce the height of said conical portion of said closure and force lateral portions of said closure to move outwardly so as to engage an inner end of said cylindrical wall and mechanically lock said closure in the opening and hold said sealing portion in sealing engagement with the container and so as to position said conical portion for inversion in response to application of sufficient inward axial force on said apex to cause further movement of said apex into the opening.

2. The method of claim 1, wherein said conical portion is flattened during the application of axial pressure.

3. The method of claim 1, further comprising the step of applying further axial pressure into to the opening to move said apex a further distance into the opening to invert said conical portion of said closure and force lateral portions of said closure to move inwardly so as to disengage said inner end of said cylindrical wall and mechanically unlock said closure from the opening.

4. The method of claim 1, wherein said axial pressure is directly applied only to the apex of said conical portion.

5. The method of claim 1, wherein the axial pressure is mechanical pressure.

6. The method of claim 1, further comprising the steps of forming a strengthening groove around the opening.

* * * * *